US009577331B2

(12) United States Patent
Tseng et al.

(10) Patent No.: US 9,577,331 B2
(45) Date of Patent: Feb. 21, 2017

(54) WIRELESS COMMUNICATION DEVICE

(71) Applicant: Wistron NeWeb Corporation, Hsinchu (TW)

(72) Inventors: Kuan-Hsueh Tseng, Hsinchu (TW); Chung-Hsuan Chen, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 84 days.

(21) Appl. No.: 14/700,168

(22) Filed: Apr. 30, 2015

(65) Prior Publication Data

US 2016/0049719 A1 Feb. 18, 2016

(30) Foreign Application Priority Data

Aug. 15, 2014 (TW) ..... 103214641 U

(51) Int. Cl.

| | |
|---|---|
| ***H01Q 1/24*** | (2006.01) |
| ***H01Q 5/371*** | (2015.01) |
| ***H01Q 9/42*** | (2006.01) |
| ***H01Q 21/28*** | (2006.01) |

(52) U.S. Cl.

CPC ..... *H01Q 5/371* (2015.01); *H01Q 1/243* (2013.01); *H01Q 9/42* (2013.01); *H01Q 21/28* (2013.01)

(58) Field of Classification Search

CPC ..... H01Q 13/106; H01Q 1/24; H01Q 1/243; H01Q 21/28; H01Q 5/10; H01Q 5/371; H01Q 9/42

USPC ..... 343/705, 700 MS, 702, 829, 846, 848

See application file for complete search history.

(56) References Cited

U.S. PATENT DOCUMENTS

| | | | | |
|---|---|---|---|---|
| 6,686,886 | B2 * | 2/2004 | Flint | H01Q 1/22 343/700 MS |
| 8,957,814 | B2 * | 2/2015 | Eom | H01Q 1/243 343/702 |
| 9,065,168 | B2 * | 6/2015 | Chun | H01Q 1/243 |
| 9,160,075 | B2 * | 10/2015 | Tsai | H01Q 9/42 |
| 9,190,713 | B2 * | 11/2015 | Eom | H01Q 1/243 |
| 9,343,802 | B2 * | 5/2016 | Su | H01Q 1/243 |
| 2012/0009983 | A1 * | 1/2012 | Mow | H01Q 1/243 455/575.7 |
| 2012/0229347 | A1 * | 9/2012 | Jin | H01Q 1/243 343/702 |
| 2014/0087674 | A1 * | 3/2014 | Teng | H01Q 5/35 455/90.3 |

* cited by examiner

*Primary Examiner* — Tho G. Phan

(74) *Attorney, Agent, or Firm* — Winston Hsu; Scott Margo

(57) ABSTRACT

A wireless communication device includes a metal frame, a mechanical part on which a ground is formed for providing grounding, and at least one antenna, wherein each one of the at least one antenna includes a radiator, a feed terminal electrically connected to the radiator, disposed adjacent to the metal frame and for feeding a radio-frequency signal, a first ground terminal disposed at a first side of the feed terminal for electrically connecting the metal frame with the ground of the mechanical part, and a second ground terminal disposed at a second side of the feed terminal for electrically connecting the metal frame with the ground of the mechanical part, wherein an area enclosed by the metal frame, the mechanical part and the first and second ground terminals forms a first slot.

14 Claims, 6 Drawing Sheets

WIRELESS COMMUNICATION DEVICE

BACKGROUND OF THE INVENTION

1. Field of the Invention

The present invention relates to a wireless communication device, and more particularly, to a wireless communication device having a feed terminal disposed adjacent to a metal frame and two ground terminals disposed at different sides of the feed terminal to adapt to mechanical design.

2. Description of the Prior Art

An antenna is used for transmitting or receiving radio waves, to communicate or exchange wireless signals. An electronic product with a wireless communication function, such as a laptop, a personal digital assistant (PDA), etc., usually accesses a wireless network through a built-in antenna. Therefore, for facilitating a user to access the wireless communication network, an ideal antenna should have a wide bandwidth and a small size to meet the trend of compact electronic products, so as to integrate the antenna into a portable wireless communication device. In addition, an ideal antenna should cover different frequency bands required for different wireless communication networks.

Most of the portable wireless communication devices utilize a metal housing or a metal frame for decoration and robustness, which may cause decreased antenna gain, narrowed bandwidth or unstable antenna performance due to the metal housing or frame when the antenna is integrated in the portable wireless communication device. In such a situation, a designer not only faces a challenge of the antenna performance but also takes integration between antenna and the metal frame into consideration when integrating the antenna into the portable wireless communication device.

Therefore, how to design a wideband antenna to adapt to a mechanical design of the wireless communication device when integrating the antenna into the portable wireless communication device has become a goal in the industry.

SUMMARY OF THE INVENTION

It is therefore an objective of the present invention to provide a wireless communication device having a feed terminal disposed adjacent to a metal frame and two ground terminals disposed at different sides of the feed terminal to adapt to mechanical design.

An embodiment of the present invention discloses a wireless communication device. The wireless communication device includes a metal frame, mechanical part disposed in an area enclosed by the metal frame, wherein the mechanical part on which a ground is formed for providing grounding, and a first antenna disposed in an area enclosed by the metal frame. The first antenna includes a radiator, a feed terminal electrically connected to the radiator, disposed adjacent to the metal frame, and used for feeding a radio-frequency signal, a first ground terminal disposed at a first side of the feed terminal for electrically connecting the metal frame and the ground of the mechanical part, and a second ground terminal disposed at a second sided of the feed terminal for electrically connecting the metal frame and the ground of the mechanical part, wherein an area enclosed by the metal frame, the mechanical part, the first ground terminal, and the second ground terminal forms a first slot.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
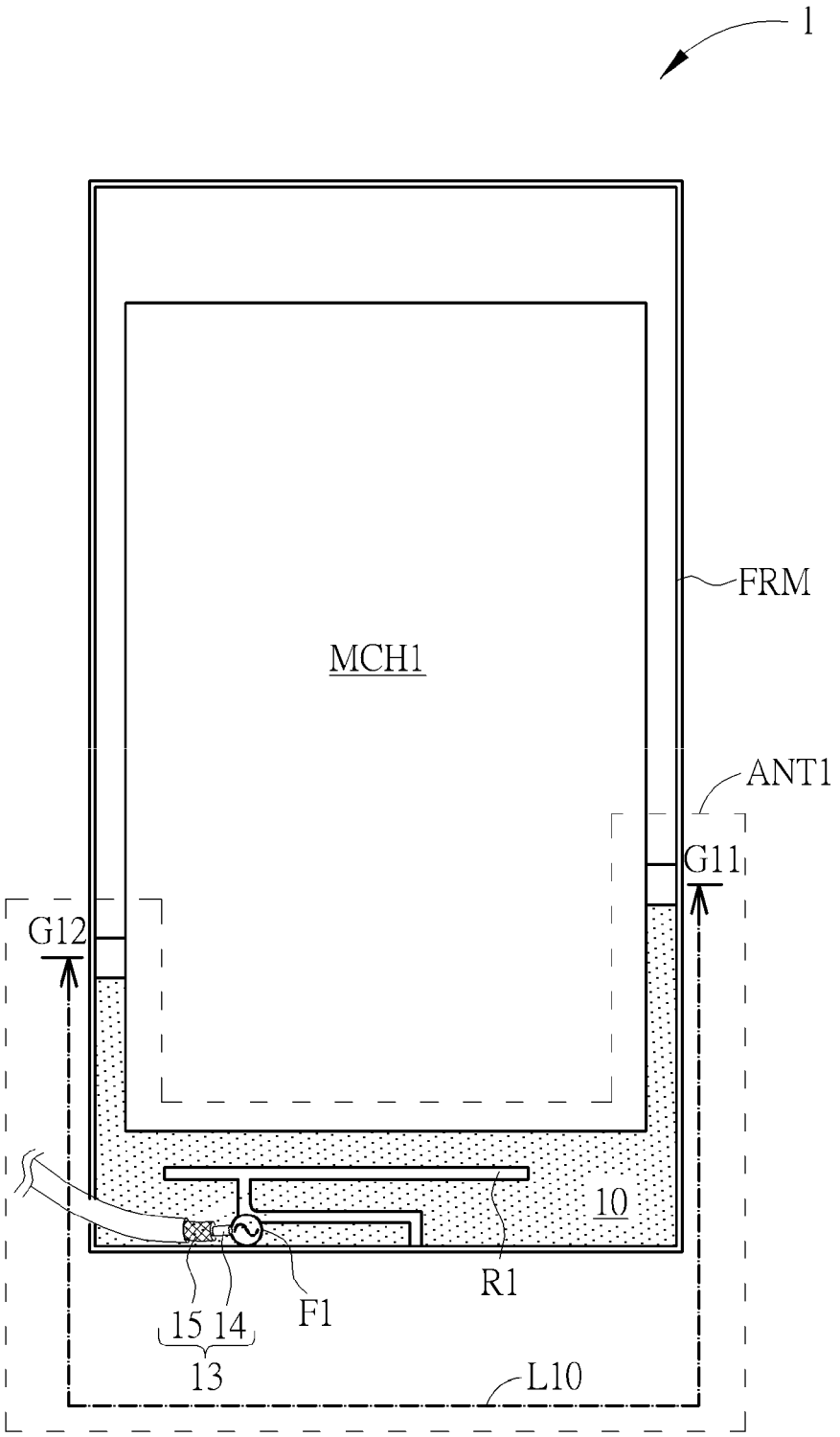
FIG. 1 is a schematic diagram of a wireless communication device according to a first embodiment of the present invention.

Please refer to FIG. 1, which is a schematic diagram of a wireless communication device 1 according to a first embodiment of the present invention. For description, the wireless communication device 1 is described as a handheld mobile device, which is not limited. The wireless communication device 1 may be a tablet computer, a laptop computer, a personal digital assistant, or and electronic device having a function of wireless communication. The wireless communication device 1 includes a metal frame FRM, a mechanical part MCH1, an antenna ANT1, and a housing (not shown in FIG. 1).

In structure, the metal frame FRM may form a part of the housing, and enclose the wireless communication device 1 in one piece. The mechanical part MCH1 is disposed in an area enclosed by the metal frame FRM, wherein a ground may be formed in the mechanical part MCH1 for providing grounding. The mechanical part MCH1 may be a metal back cover to be formed as a part of the housing. Or, the mechanical part MCH1 may be a circuit board disposed in the housing. The antenna ANT1 may be disposed in the area enclosed by the metal frame FRM for transmitting and receiving wireless signals to realize wireless communication.

The antenna ANT1 includes a radiator R1, a feed terminal F1, ground terminals G11 and G12, and a coaxial cable 13. The feed terminal F1 may be electrically connected to the radiator R1 for feeding a radio-frequency signal, wherein the feed terminal F1 may be disposed adjacent to the metal frame FRM. The coaxial cable 13 includes an inner core 14 and an outer shield 15. The inner core 14 may be electrically connected to the feed terminal F1 via soldering to transmit the radio-frequency signal to a radio-frequency signal processor of wireless communication device 1 (not shown in FIG. 1). The outer shield 15 may be electrically connected to metal frame FRM via soldering to be electrically connected to the ground via the metal frame FRM. The ground terminal G11 may be disposed at a first side of the feed terminal F1 for electrically connecting the metal frame FRM and the ground of the mechanical part MCH1. The ground terminal G12 may be disposed at a second side of the feed terminal F1 for electrically connecting the metal frame FRM and the ground of the mechanical part MCH1. In other words, the ground terminals G11 and G12 may be respectively disposed at different sides of the feed terminal F1. An area enclosed by the metal frame FRM, the mechanical part MCH1, and the ground terminals G11 and G12 may form a slot 10. A length L10 along the metal frame FRM is between the ground terminals G11 and G12, and the length L10 may substantially range from a quarter wavelength to a half wavelength of a minimum operating frequency of the radio-frequency signal to excite a resonant mode corresponding to the radio-frequency signal.

In operation, during transmission and reception operations of the wireless communication device 1, the radio-frequency signal is fed to the feed terminal F1, the antenna ANT1 may directly radiate the radio-frequency signal in the air via radiator R1. Meanwhile, since the slot 10 forms a closed resonant cavity, a coupling effect may be induced between the radiator R1 and the slot 10 to radiate the radio-frequency signal by the coupling effect. As a result, the antenna ANT1 may radiate the radio-frequency signal via direct radiation and the coupling effect to perform wireless communication.

Under the structure above mentioned, a radio-frequency current of the radio-frequency signal may be distributed on the radiator R1 and surroundings of the enclosed slot 10 due to the coupling effect induced between the radiator R1 and the slot 10. In addition, the feed terminal F1 fed with the radio-frequency signal is disposed adjacent to the metal frame FRM, and the ground terminals G11 and G12 are disposed at different sides of the feed terminal F1, thereby most of a return current or image current of the radio-frequency signal may be guided to the metal frame FRM to return to the ground via the ground terminals G11 and G12. As a result, the return current of the radio-frequency signal may be blocked from flowing to other parts of the metal frame FRM other than surroundings of the slot 10.

In other words, a part of the metal frame FRM may be regarded as a radiator of the antenna ANT1 (i.e. the surroundings of the slot 10) to radiate the radio-frequency signal by the coupling effect. In addition, the radio-frequency signal is disposed adjacent to the metal frame FRM, and the ground terminals G11 and G12 are disposed at different sides of the feed terminal F1, in such a structure, the return current of the radio-frequency signal may be blocked from flowing to another parts of the metal frame FRM other than the surroundings of the slot 10. Therefore, assume that a user holds the metal frame FRM without touching the slot 10, an influence due to a human body of the user to the wireless communication device 1 may be reduced to maintain an antenna performance of the antenna ANT1.

Noticeably, the embodiment of the present invention utilizes a part of the metal frame FRM to be the radiator of the antenna ANT1 to effectively utilizes mechanical parts of the wireless communication device 1, such that the metal frame FRM may have versatile functions such as decoration, endurance, and wireless signal radiation, so as to cleverly integrate the antenna ANT1 in the wireless communication device 1 and adapt to mechanical designs.

In short, the embodiment of the present invention utilizes a part of the metal frame FRM, the mechanical part MCH1, and the ground terminals G11 and G12 to form the slot 10, such that the coupling effect between the radiator R1 and the slot 10 may be induced to radiate the radio-frequency signal in the air by the coupling effect. Meanwhile, the radio-frequency signal is disposed adjacent to the metal frame FRM, and the ground terminals G11 and G12 are disposed at different sides of the feed terminal F1, in such a structure, the interference due to the human body to the wireless communication device 1 may be reduced to maintain the antenna performance. Therefore, the metal frame FRM may have versatile functions such as decoration, endurance, and wireless signal radiation, so as to cleverly integrate the antenna ANT1 in the wireless communication device and adapt to mechanical designs.

Please note that those skilled in the art may made modifications and alterations based on the structure of the wireless communication device above mentioned, which is not limited. For example, a method for feeding the radio-frequency signal is not limited. Specifically, the coaxial cable 13 may be replaced by a pair of pogo pins to be electrically connected to the feed terminal F1 and the metal frame FRM, respectively. Further, the slot enclosed by the metal frame FRM, the mechanical part MCH1, and the ground terminals G11 and G12 may have any shape and size, wherein adjustments to the shape and size of the slot are not limited. For example, a designer may adjust locations where the ground terminals G11 and G12 are electrically connected to the metal frame FRM to adjust the shape and size of the slot 10 and the operating frequency of the antenna ANT1 in order to meet practical requirements. Or, the designer may adjust a size of the mechanical part to make the mechanical part being attached to the metal frame FRM, such that the mechanical part may be directly electrically connected to the metal frame FRM.

Figure 2:
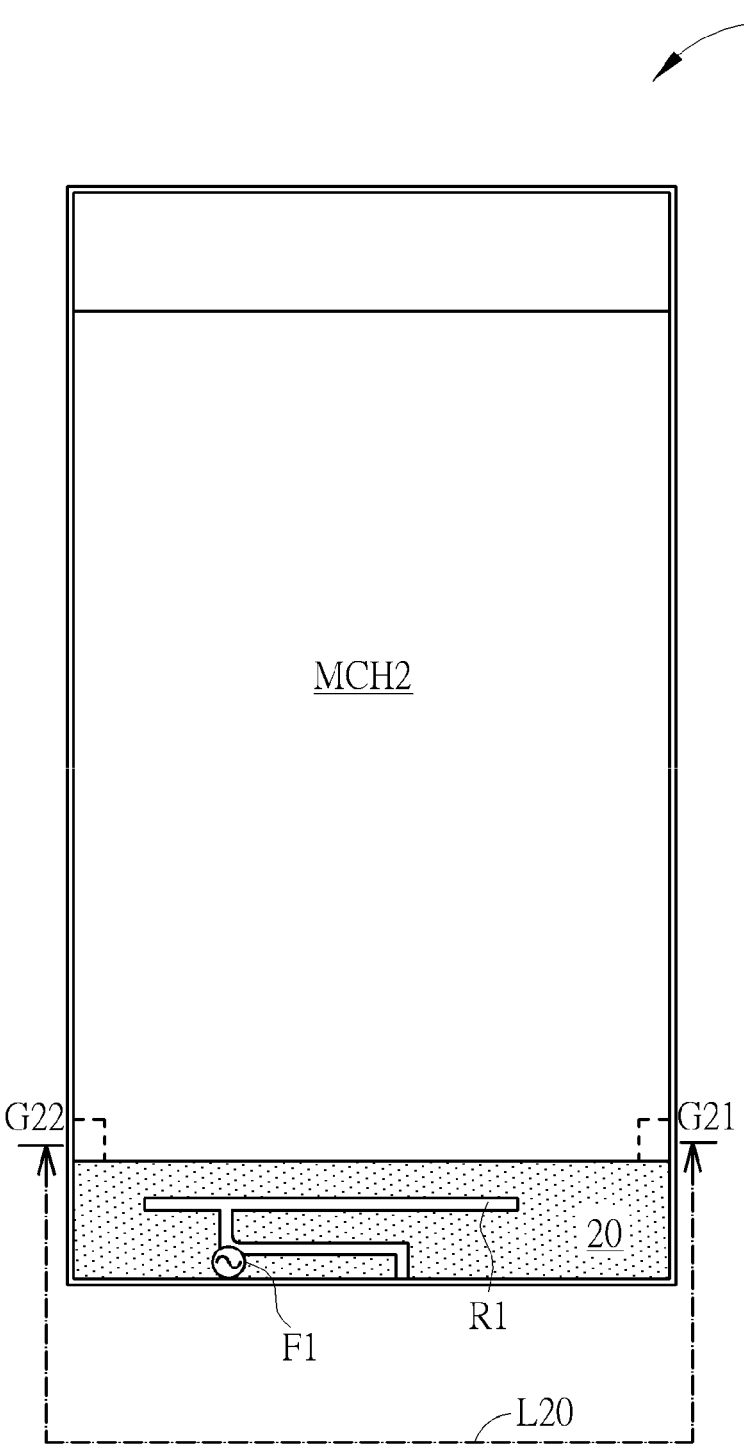
FIG. 2 is a schematic diagram of a wireless communication device according to a second embodiment of the present invention.

Specifically, please refer to FIG. 2, which is a schematic diagram of a wireless communication device 2 according to a second embodiment of the present invention. A difference between the wireless communication devices 1 and 2 is that the mechanical part MCH1 of the wireless communication device 1 is indirectly electrically connected to the metal frame FRM via the ground terminals G11 and G12. While a mechanical part MCH2 of the wireless communication device 2 may be attached to the metal frame FRM, such that the mechanical part MCH2 may be directly electrically connected to the metal frame FRM. In such a structure, the mechanical part MCH2 may be regarded as a metal back cover, and an area enclosed by the mechanical part MCH2 and the metal frame FRM may form a slot 20. The slot 20 may have a length L20 (i.e. a length along the metal frame FRM between connect terminals G21 and G22), wherein the length L20 may substantially range from a quarter wavelength to a half wavelength of the minimum operating frequency of the radio-frequency signal to activate a resonant mode corresponding to the radio-frequency signal.

Noticeably, due to appearance considerations, input and/or output ports, speaker, or microphone of the wireless communication device may be formed on the metal frame FRM, and thus there may be several openings formed in the metal frame FRM. Accordingly, the present invention may utilize the openings on the metal frame FRM of the wireless communication device to match the antenna structure, so as to cleverly integrate the antenna into the wireless communication device.

Figure 3:
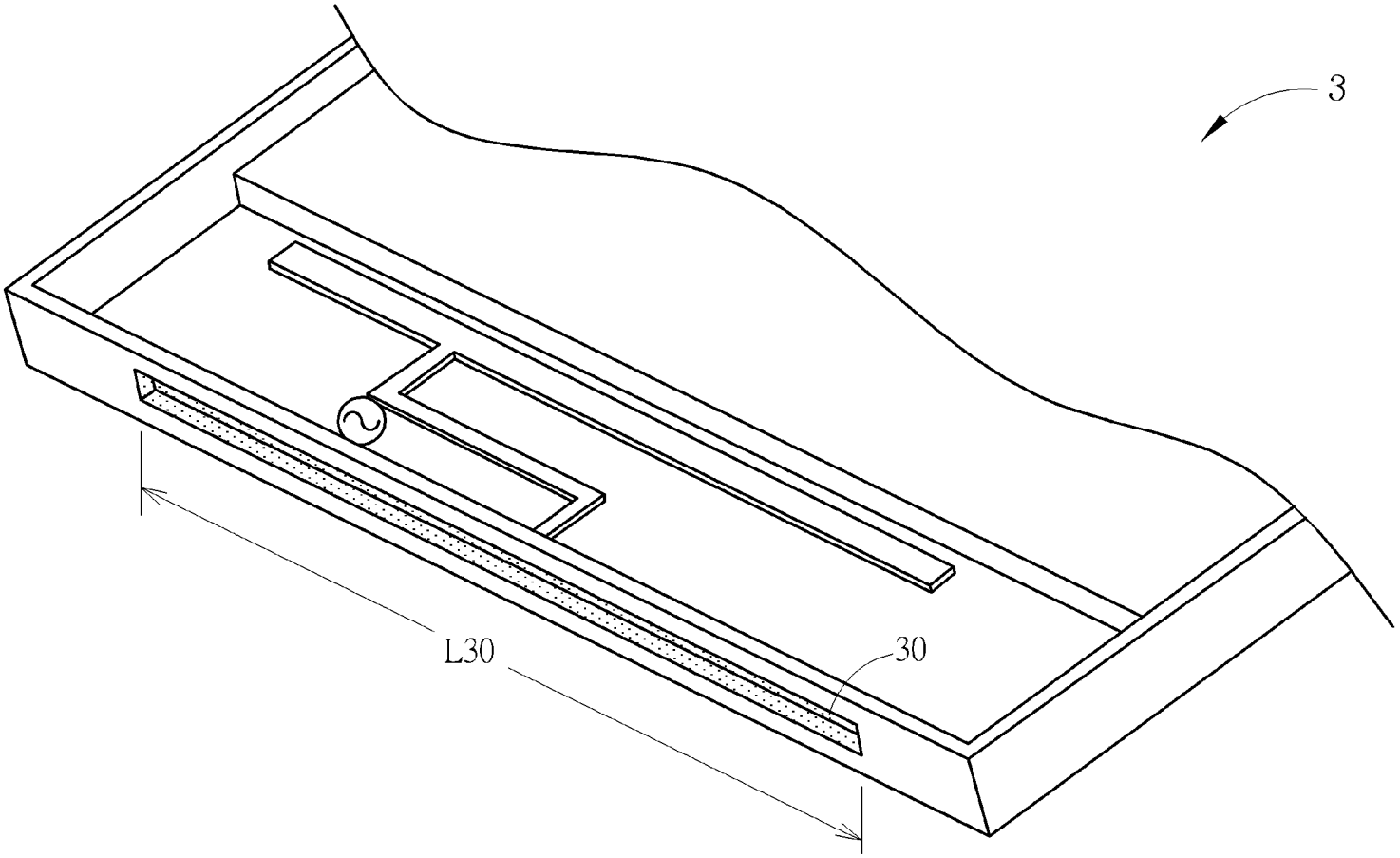
FIG. 3 is a schematic diagram of a wireless communication device according to a third embodiment of the present invention.

Specifically, please refer to FIG. 3, which is a schematic diagram of a wireless communication device 3 according to a third embodiment of the present invention. A difference between the wireless communication devices 2 and 3 is that an enclosed slot 30 is formed in a part of the metal frame FRM adjacent to the antenna of the wireless communication device 3. The slot 30 may be used for exciting another resonant mode to broaden a frequency bandwidth of the antenna. The slot 30 may have a length L30, which may substantially be a wavelength of a resonant mode.

Figure 4:
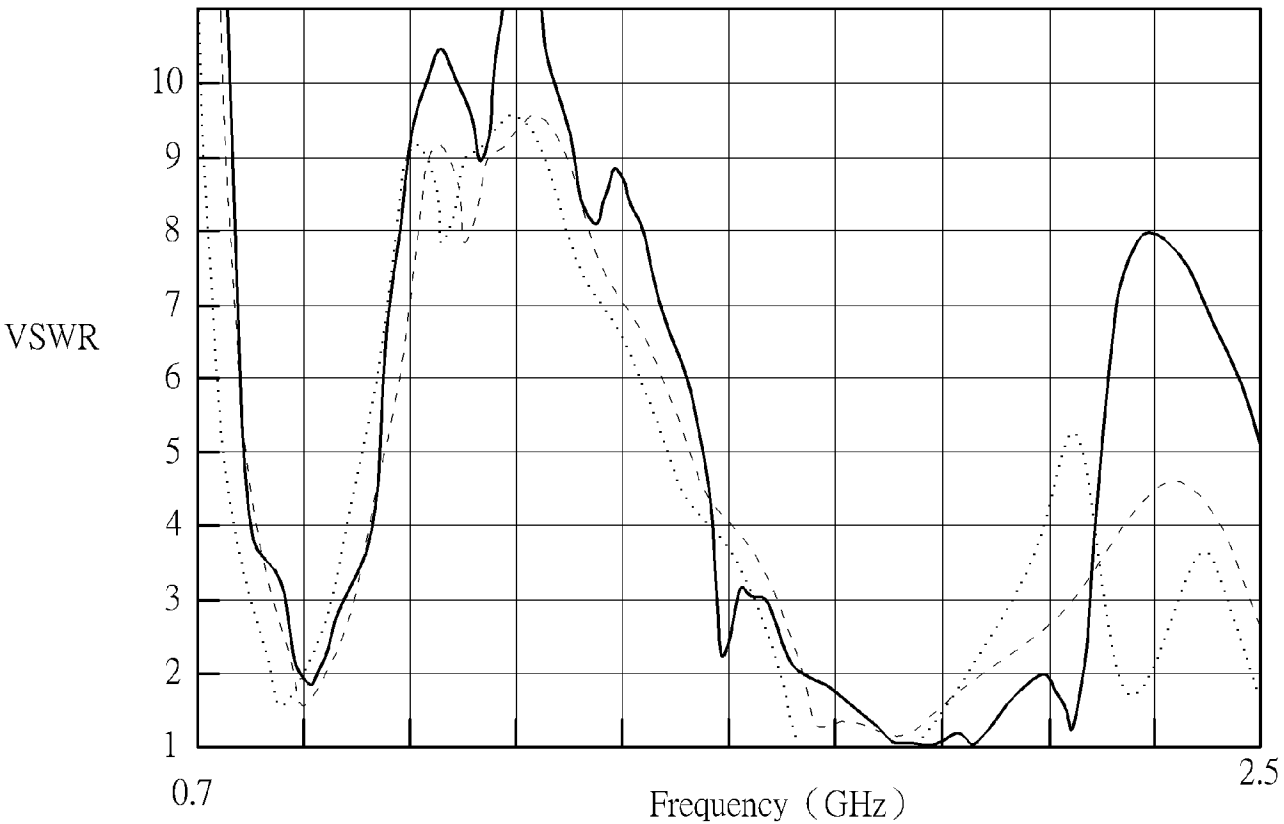
FIG. 4 illustrates Voltage Standing Wave Ratios of the antennas of the first to third embodiments corresponding to different slots.

Please refer to FIG. 4, which illustrates Voltage Standing Wave Ratios (VSWR) of the antennas of the wireless communication devices 1, 2, and 3 corresponding to different slots. The VSWRs of the antennas of the wireless communication devices 1, 2, and 3 are denoted with a solid line, a dashed line, and a dotted line, respectively. As shown in FIG. 4, given shapes and sizes of the radiator R1 and the feed terminal F1 are fixed, adjusting sizes of the slots 10 and 20 may adjust the operating frequency of the antenna ANT1, and another resonant mode may be excited by the slot 30 formed in the metal frame FRM to increase another frequency band and broaden the frequency bandwidth of the antenna.

Figure 5:
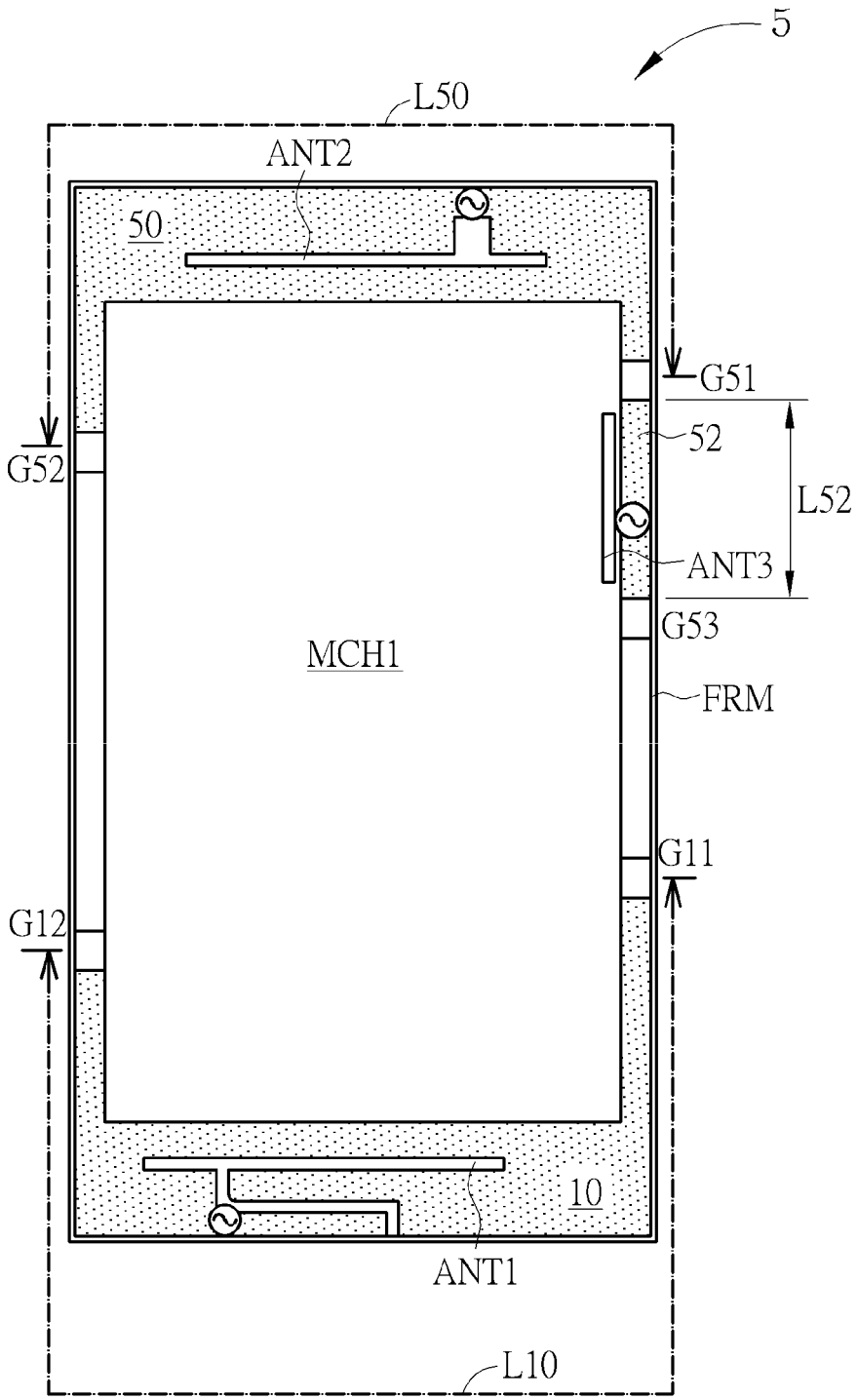
FIG. 5 is a schematic diagram of a wireless communication device according to a fourth embodiment of the present invention.

Moreover, there may be multiple antennas configured in the wireless communication device to support antenna diversity technology, Multi-input Multi-output (MIMO) technology, or at least two communication schemes. Please refer to FIG. 5, which is a schematic diagram of a wireless communication device 5 according to a fourth embodiment of the present invention. A difference between the wireless communication devices 1 and 5 is that the wireless communication device 5 further includes antennas ANT2 and ANT3 to operate in the wireless communication system supporting at least two communication schemes, such as a third generation mobile communication technology (3G), a Long Term Evolution (LTE) communication technology, and Wi-Fi.

Structures of the antennas ANT1, ANT2, and ANT3 are similar, each of them includes a radiator, a feed terminal and corresponding two of the ground terminals G11, G12, G51, G52, and G53. The ground terminals G51 and 52 of the antenna ANT2 may be disposed at different sides of the feed terminal for electrically connecting the metal frame FRM and the ground of the mechanical part MCH1. An area enclosed by the metal frame FRM, the mechanical part MCH1, and the ground terminals G51 and G52 may form a slot 50. A length L50 along the metal frame FRM is between the ground terminals G51 and G52, which may substantially range from a quarter wavelength to a half wavelength of a minimum operating frequency of the radio-frequency signal to activate a resonant mode of the radio-frequency signal. The antennas ANT1 and ANT2 have a larger size to support the wireless communication schemes having higher operating frequencies such as the third generation mobile communication or LTE.

Likewise, the ground terminals G51 and G53 of the antenna ANT3 may be disposed at different sides of the feed terminal for electrically connecting the metal frame FRM and the ground of the mechanical part MCH1. An area enclosed by the metal frame FRM, the mechanical part MCH1, and the ground terminals G51 and G53 may form a slot 52. A length L52 along the metal frame FRM is between the ground terminals G51 and G53, which may substantially range from a quarter wavelength to a half wavelength of a minimum operating frequency of the radio-frequency signal to activate a resonant mode of the radio-frequency signal. In this embodiment, a size of the antenna ANT3 may be smaller than sizes of the antennas ANT1 and ANT2, the antenna ANT3 may support wireless communication schemes having higher operating frequencies such as Wi-Fi.

Please note that in the fourth embodiment, the antennas ANT2 and ANT3 may commonly use the same ground terminal G51, as long as the ground terminals G51, G52, and G53 are disposed at different sides of the feed terminals to form the enclosed slots 50 and 52, respectively. In addition, the radiators of the antennas ANT1 and ANT2 may be completely disposed in the area enclosed by the slots 10 and 50, while a part of the radiator of the antenna ANT3 may not be disposed in the slot 52.

Figure 6:
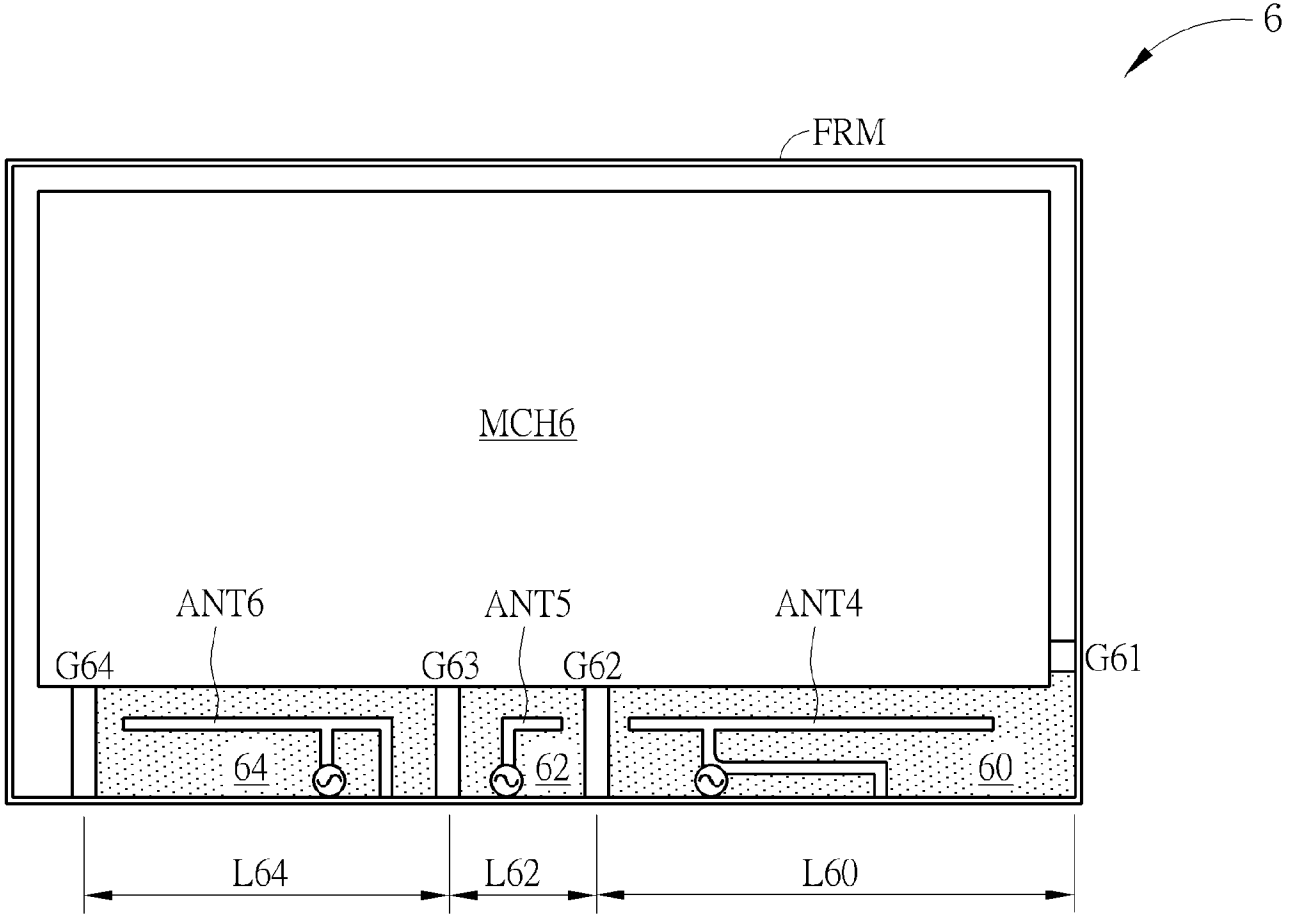
FIG. 6 is a schematic diagram of a wireless communication device according to a fifth embodiment of the present invention.

In addition, relative locations between the multiple antennas may be adjusted according to practical requirements. Specifically, please refer to FIG. 6, which is a schematic diagram of a wireless communication device 6 according to a fifth embodiment of the present invention. A difference between the wireless communication devices 5 and 6 is that the antennas ANT1, ANT2, and ANT3 of the wireless communication device 5 are respectively disposed at one of the four sides of the metal frame. While antennas ANT4, ANT5, and ANT6 of the wireless communication device 6 are disposed at a same side of the metal frame, and the antennas ANT4, ANT5, and ANT6 are sequentially disposed.

In the antenna ANT4, an area enclosed by the metal frame FRM, the mechanical part MCH6, and the ground terminals G61 and G62 may form a slot 60. A length L60 along the metal frame FRM is between the ground terminals G61 and G62, which may substantially range from a quarter wavelength to a half wavelength of a minimum operating frequency of the radio-frequency signal to activate a resonant mode of the radio-frequency signal.

In the antenna ANT5, an area enclosed by the metal frame FRM, the mechanical part MCH6 and the ground terminals G62 and G63 may form a slot 62. A length L62 along the metal frame FRM is between the ground terminals G62 and G63, which may substantially range from a quarter wavelength to a half wavelength of a minimum operating frequency of the radio-frequency signal to activate a resonant mode of the radio-frequency signal.

In the antenna ANT6, an area enclosed by the metal frame FRM, the mechanical part MCH6 and the ground terminals G63 and G64 may form a slot 64. A length L64 along the metal frame FRM is between the ground terminals G63 and G64, which may substantially range from a quarter wavelength to a half wavelength of a minimum operating frequency of the radio-frequency signal to activate a resonant mode of the radio-frequency signal.

In the fifth embodiment, the antennas ANT4 and ANT5 may commonly use the ground terminal G62, and the antennas ANT5 and ANT6 may commonly use the ground terminal G63. Take the antenna ANT5 for example, the ground terminals G62 and G63 of the antenna ANT5 are disposed at different sides of the feed terminal to form the slot 62.

In the first to fifth embodiments, the antenna may have various types, which may be a monopole antenna, a T-shaped antenna, a dipole antenna, a planar inverted F antenna (PIFA), a loop antenna, a slot antenna, or a coupling antenna, a designer may select one or more of the antennas above mentioned to utilize in the wireless communication device. For example, the antennas ANT1 and ANT4 may be a T-shaped antenna having a ground branch, the antennas ANT2 and ANT3 may be a T-shaped monopole antenna, the antenna ANT5 may be a monopole antenna, and the antenna ANT6 may be a PIFA.

To sum up, the present invention disposes the feed terminal adjacent to the metal frame FRM, and disposes the ground terminals at different sides of the feed terminal, in such a structure, the influence due to the human body of the user to the wireless communication device 1 may be reduced to maintain the antenna performance. Therefore, the present invention is able to effectively utilize the metal frame, such that the metal frame may have versatile functions such as decoration, endurance, and wireless signal radiation, so as to cleverly integrate the antenna in the wireless communication device and adapt to mechanical designs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wireless communication device, comprising a metal frame;

a mechanical part disposed in an area enclosed by the metal frame, wherein a ground is formed on the mechanical part for providing grounding;

a first antenna disposed in an area enclosed by the metal frame, the first antenna comprises:

a radiator;

a feed terminal electrically connected to the radiator, disposed adjacent to the metal frame, and used for feeding a radio-frequency signal;

a first ground terminal disposed at a first side of the feed terminal for directly and electrically connecting the metal frame and the ground of the mechanical part; and a second ground terminal disposed at a second side of the feed terminal for directly and electrically connecting the metal frame and the ground of the mechanical part;

wherein an area enclosed by the metal frame, the mechanical part, the first ground terminal, and the second ground terminal forms a first slot, and the first antenna is disposed in the first slot.

2. The wireless communication device of claim 1, wherein a first length along the metal frame is between the first and second ground terminals, and the first length substantially ranges from a quarter wavelength to a half wavelength of a minimum operating frequency of the radio-frequency signal.

3. The wireless communication device of claim 1, wherein a second slot is formed in a part of the metal frame adjacent to the first antenna for exciting a resonant mode, and the second slot has a second length which is substantially a wavelength of a minimum operating frequency of the resonant mode.

4. The wireless communication device of claim 1, wherein the first antenna further comprises a coaxial cable, and the coaxial cable comprises:

an inner core electrically connected to the feed terminal for transmitting the radio-frequency signal to a radio-frequency signal processor of the wireless communication device; and an outer shield, electrically connected to the metal frame.

5. wireless communication device of claim 4, wherein the outer shield is electrically connected to the ground via the metal frame.

6. wireless communication device of claim 1, further comprising a housing, wherein the metal frame forms a part of the housing and encloses the wireless communication device in one piece.

7. The wireless communication device of claim 6, wherein the mechanical part is a metal back cover, and the metal back cover forms a part of the housing.

8. The wireless communication device of claim 6, wherein the mechanical part is a circuit board disposed in the housing.

9. The wireless communication device of claim 1, wherein a part of the radiator is not disposed in the first slot.

10. The wireless communication device of claim 1, further comprising a second antenna.

11. The wireless communication device of claim 10, wherein the first and second antennas commonly comprise the first ground terminal or the second ground terminal.

12. The wireless communication device of claim 10, wherein the first and second antenna is respectively disposed adjacent to one side of the metal frame.

13. The wireless communication device of claim 10, wherein the first and second antennas are disposed adjacent to one side of the metal frame.

14. The wireless communication device of claim 1, wherein the first antenna is a monopole antenna, a T-shaped antenna, a dipole antenna, a planar inverted F antenna, a loop antenna, a slot antenna, or a coupling antenna.

* * * * *